US010527393B1

(12) United States Patent
Sapp et al.

(10) Patent No.: US 10,527,393 B1
(45) Date of Patent: Jan. 7, 2020

(54) MEDIUM CALIBER HIGH KINETIC ENERGY ROUND WITH TRACER AND SELF-DESTRUCT MECHANISM

(71) Applicant: U.S. Government as Represented by the Secretary of the Army, Picatinny Arsenal, Dover, NJ (US)

(72) Inventors: Nicole Sapp, Augusta, NJ (US); Jeffrey Darbig, Flanders, NJ (US); Jonathan Escobar, Stony Point, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/166,266

(22) Filed: Oct. 22, 2018

Related U.S. Application Data

(60) Provisional application No. 62/574,800, filed on Oct. 20, 2017.

(51) Int. Cl.
*F42B 12/06* (2006.01)
*F42B 8/14* (2006.01)
*F42B 12/62* (2006.01)

(52) U.S. Cl.
CPC ..... *F42B 12/06* (2013.01); *F42B 8/14* (2013.01); *F42B 12/62* (2013.01)

(58) Field of Classification Search
CPC ..... F42B 12/16; F42B 12/18
See application file for complete search history.

(56) References Cited

U.S. PATENT DOCUMENTS

| | | | | |
|---|---|---|---|---|
| 3,677,181 | A * | 7/1972 | Giljarhus | F42B 12/204 102/364 |
| 8,250,987 | B1 | 8/2012 | Morley | |
| 8,640,624 | B1 | 2/2014 | Hassan | |
| 9,329,008 | B1 | 5/2016 | Gilbert | |
| 2002/0152914 | A1 * | 10/2002 | Cox | F42B 12/36 102/501 |
| 2007/0017409 | A1 * | 1/2007 | Mansfield | F42B 12/06 102/518 |
| 2012/0216699 | A1 | 8/2012 | Fanucci | |

* cited by examiner

*Primary Examiner* — J. Woodrow Eldred
(74) *Attorney, Agent, or Firm* — John P. DiScala

(57) ABSTRACT

A medium caliber high kinetic energy round with tracer and self-destruct mechanism having an optimized kinetic energy projectile incorporating a fully hardened projectile body and an explosive self-destruct mechanism for a medium caliber high rate of fire round. The medium caliber high kinetic energy ammunition round incorporates a multiple piece sub-projectile that integrates a tracer and high explosive self-destruct mechanism to neutralize the penetrator during self-destruct and minimize collateral damage during firing.

9 Claims, 1 Drawing Sheet

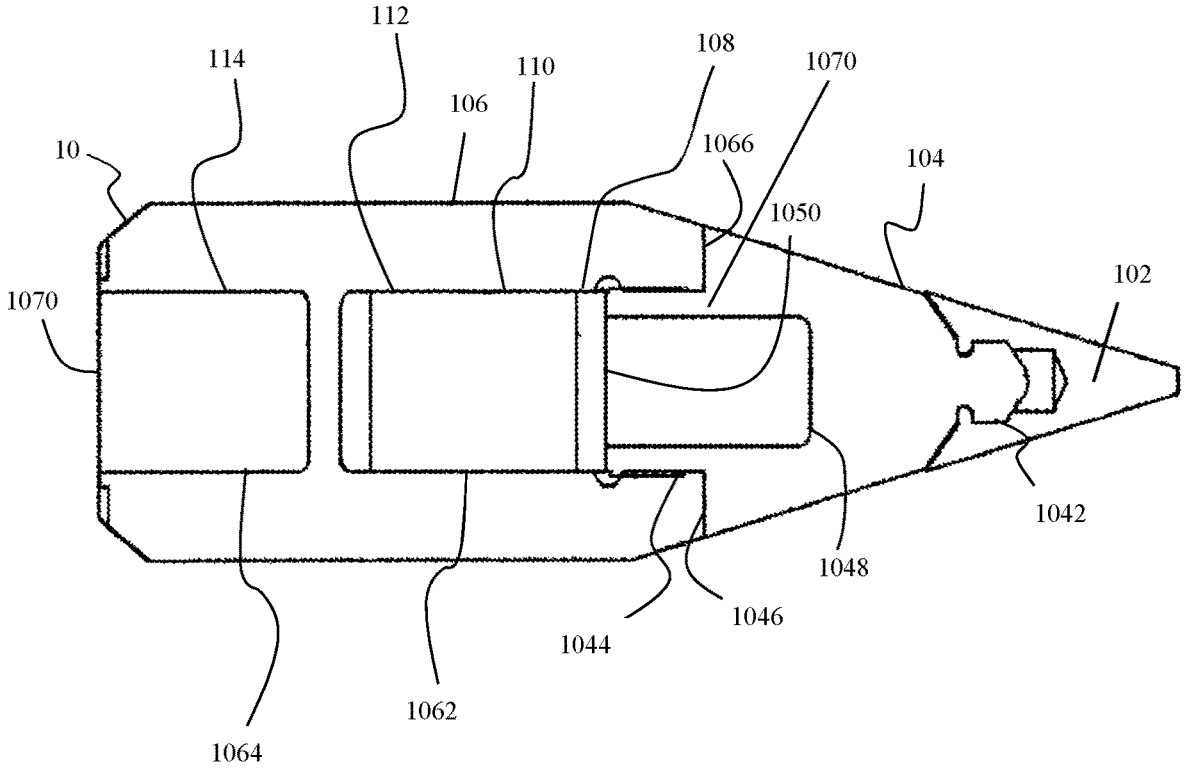
112
114
108
1070
110
106
1066
10
104
1050
102
1070
1042
1048
1046
1044
1062
1064

MEDIUM CALIBER HIGH KINETIC ENERGY ROUND WITH TRACER AND SELF-DESTRUCT MECHANISM

CROSS-REFERENCE TO RELATED APPLICATIONS

This application claims the benefit under 35 USC § 119(e) of U.S. provisional patent application 62/574,800 filed on Oct. 20, 2017.

STATEMENT OF GOVERNMENT INTEREST

The inventions described herein may be manufactured, used and licensed by or for the United States Government.

BACKGROUND OF THE INVENTION

The invention relates in general to ammunition and in particular to medium caliber ammunition.

Military installations face increased risk from rockets, artillery, and mortar (RAM) threats. To protect against these threats, Counter rocket, artillery and mortar (C-RAM) systems are employed to engage incoming RAM threats. The need for increased performance from C-RAM systems arises as new or improved threats emerge.

One medium caliber ammunition currently used in C-RAM systems was initially developed as an anti-aircraft munition and optimized to destroy thin skinned targets. As such, the activation mechanism in the round is sensitive and may initiate the high explosive in the warhead prior to penetration into RAM targets. Another round currently used by naval systems for a similar mission utilizes a sub-caliber tungsten penetrator to increase performance; however, this solution lacks a self-destruct mechanism which is necessary for a land-based system to ensure unengaged falling rounds do cause unintended damage.

Accordingly, a need exists for a medium caliber cartridge solution that targets emerging RAM threats with improved penetration and detonation delay. Additionally, the ammunition requires tracer and self-destruct features for use in a land-based system.

SUMMARY OF INVENTION

One aspect of the invention is an ammunition round having an optimized kinetic energy projectile incorporating a fully hardened projectile body and an explosive self-destruct mechanism for a medium caliber high rate of fire round. The ammunition round incorporates a multiple piece sub-projectile that integrates a tracer and high explosive self-destruct mechanism to neutralize the penetrator during self-destruct and minimize collateral damage during firing.

Another aspect of the invention is a projectile for an ammunition round, the projectile comprising a hardened penetrator assembly, an explosive charge assembly and a tracer charge. The hardened penetrator assembly further comprises a penetrator nose and a penetrator body positioned rearward and aligned with the penetrator nose. The penetrator nose comprises a tip extending from a front of the penetrator nose, a cylindrical base extending from the rear of the penetrator nose and a nose cavity having an opening in the cylindrical base. The penetrator body has a main cavity with an opening in a front of the penetrator body and a base cavity having an opening in a base of the penetrator body. The main cavity partially receiving the penetrator nose. The explosive charge assembly comprises an explosive charge and a self-destruct initiation charge housed within the main cavity for extending the ballistic effect of the projectile when a target is engaged and for self-destructing the projectile when a target is not engaged. The tracer charge is housed within the base cavity for tracing a projectile trajectory and initiating the self-destruct initiation charge after a predetermined time in which a target is not engaged.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1 is a side cross-sectional view of a projectile with a fully hardened projectile body and an explosive self-destruct mechanism for a medium caliber high kinetic energy ammunition round, in accordance with one embodiment.

DETAILED DESCRIPTION

A medium caliber high kinetic energy round includes an optimized kinetic energy projectile which has a fully hardened body and incorporates tracer and explosive self-destruct mechanisms. The medium caliber high kinetic energy ammunition round incorporates a multiple piece sub-projectile that integrates a tracer and high explosive self-destruct mechanism to neutralize the penetrator during self-destruct and minimize collateral damage during firing. This combination of hardened penetrator and self-destruct mechanism satisfies the dual needs of increased lethality with minimization of unintended harm.

The self-destruct mechanism, in particular, is required for use in U.S. military land based C-RAM systems and allows for use over friendly forces. Approximately less than 1% of rounds fired from a C-RAM system, such as the Land Based Phalanx Weapon System, actually engage the target. The medium caliber high kinetic energy ammunition round utilizes a multiple piece sub-projectile that integrates a tracer and high explosive self-destruct mechanism to neutralize the penetrator during self-destruct and minimize collateral damage during firing. All other rounds will self-destruct in the air and fall safely to the ground.

The medium caliber high kinetic energy ammunition round leverages the envelope of the Mk244 cartridge and projectile. Advantageously, the medium caliber high kinetic energy ammunition maintains the Mk244 terminal performance capability along with tracer and self-destruct mechanisms to demonstrate performance against RAM targets. The round also maintains other benefits of the legacy Mk244 round including reduced barrel wear.

The penetrator ensures that the round penetrates hardened targets without premature initiation of the high explosive warhead and that the high explosive initiates only after penetration into the hardened target. This allows for greater terminal performance of the high explosive once initiated within the target. Tests performed have shown dramatic improvement over legacy solutions such as the M940 and no drop off in performance over the Mk244.

While described throughout this specification as being a 20×120 mm cartridge configuration based on the envelope of the Mk244 round, the medium caliber high kinetic energy ammunition round is not limited to 20×120 mm cartridge configurations or configurations fitting the Mk244 envelope. The medium caliber high kinetic energy ammunition round may be any medium caliber APDS sub-caliber kinetic energy penetrator. The medium caliber high kinetic energy ammunition round may also be applied as a training cartridge for many medium caliber armor piercing discarding sabot cartridges to limit projectile flight distances thereby allowing increased training capability on smaller ballistic ranges. The medium caliber high kinetic energy ammunition round also provides an on and off shore defense capability to naval systems, as well.

Further while the projectile is particular suited for a medium caliber C-RAM system, the projectile is not limited to C-RAM roles or to medium caliber ammunition. The projectile may be employed in a small caliber ammunition round or large caliber ammunition round.

FIG. 1 is a side cross-sectional view of a projectile with a fully hardened projectile body and an explosive self-destruct mechanism for a medium caliber high kinetic energy ammunition round, in accordance with one embodiment. The projectile is fired from a medium caliber ammunition round which comprises the projectile, a sabot, a driving band and an aluminum pusher.

The sabot surrounds the projectile and together with the aluminum pusher, houses the projectile until launch from a weapon barrel. The driving band encircles the aluminum pusher and interacts with the interior of the weapon barrel to seal propelling gases and impart spin on the round. The aluminum pusher is at the rear of the round and includes an opening to provide access to the projectile to enable tracer function.

The projectile 10 further comprises a windscreen 102, a penetrator nose 104, a penetrator body 106, an incendiary charge 108, a main explosive charge 110, a self-destruct initiation charge 112 and a tracer 114.

The windscreen 102 is attached to the tip of the projectile to provide an aerodynamic shape to the projectile and to allow optimal penetrator tip geometries for enhanced armor penetration performance.

The penetrator nose 104 is specifically designed as a separate piece of the projectile to allow loading of the explosive payload, easy break-up during self-destruct and ease of manufacture. The penetrator nose 104 also has a cavity to enhance nose breakup during self-destruct and could provide the payload volume for additional high explosive, if deemed necessary.

The penetrator nose 104 is generally conical in shape with a penetrator tip 1042 extending forward of the nose for increased penetration capabilities. A cylindrical base region 1044 extends rearward from the penetrator nose and is sized and dimensioned to be received by a corresponding opening in the penetrator body 106. A bottom surface of the penetrator nose forms a rim 1046 which interfaces with a rim of the penetrator body 106. The penetrator nose 104 comprises a nose cavity 1048 with an opening in the base of the penetrator nose 104. The nose cavity 1048 is in proximity to and exposed to the main explosive charge 110 which aids in self-destruction of the projectile.

The penetrator body 106 is separated from the penetrator nose 104 to aide in its manufacture as well as separate from other large parts of the projectile during self-destruct. The hollow cavity 1062 in the front of the penetrator body 106 allows for the addition of incendiary material 108, high explosive 110 and a self-destruct initiation charge 112 to add the self-destruct mechanism and to tailor the terminal explosive effect for better performance.

The penetrator body 106 is a generally hollow cylinder with two interior cavities, a main interior volume 1062 accessed from an opening 1068 in the front of the body 106 and another cavity 1064 accessed by an opening 1070 in the base of the projectile. The opening in the front of the penetrator body 106 is sized to partially receive the penetrator nose 104. The opening further comprises a rim 1066 which serves as a mating surface to the rim 1046 of the penetrator nose 104.

In an embodiment, the penetrator nose 104 and penetrator body 106 are manufactured from a heavy metal alloy such as a tungsten alloy.

The remaining main interior volume 1062 is filled by a main explosive charge 110 and a self-destruct initiation charge 112. In an embodiment, the main interior volume also comprises an incendiary charge 108. However, in other embodiments, the main interior volume does not comprise an incendiary charge 108. The explosive charge 110 is in communication with both the incendiary charge 108 and the self-destruct initiation charge 112, with the incendiary charge 108 forward of the explosive charge 110 and the self-destruction initiation charge 112 rearward of the explosive charge 110.

A cavity 1064 in the base of the penetrator body 106 contains the tracer assembly. The tracer assembly is exposed to the exterior environment through an opening 1070 in the base. The tracer assembly further comprises a tracer charge 114.

The medium caliber high kinetic energy ammunition round is fired from a weapon, usually by electrical or procession initiation. The initiation ignites the primer, which in turn ignites the propellant charge. The propellant burns rapidly to build pressure in the cartridge case and accelerates the projectile down the barrel of the weapon. After the projectile 10 is in motion down the barrel, the projectile 10 exits the barrel, the tracer charge 114 ignites, the sabot petals and the pusher base discard and the projectile 10 flies toward the target.

Upon engagement with the target, the hardened penetrator 104, 106 localizes the kinetic energy of the projectile 10 to increase target penetration. The windscreen 102 of the projectile 10 deforms to expose the tip 1042 of the penetrator nose 104. During the penetration event, the penetrator 104, 106 compresses and begins the initiation of the explosive charge 110 in the warhead. After full entry into the main body of the target, the explosive charge 110 is fully initiated which inflicts maximum damage to the target.

All rounds that do not engage a target continue to fly until the tracer burns low enough to ignite the high explosive 110 and break apart the projectile 10. The tracer charge heats a thin region 1066 of the body 106 between the tracer charge 114 and the self-destruct initiation charge 112. The explosive gases of the explosive charge enter the opening 1050 of the hollow cavity 1048 in the penetrator nose which fills with the explosive gases thereby facilitating self-destruction. The hardened penetrator 104, 106 is broken up into smaller pieces than those of the solid legacy MK244 projectile thereby increasing safety and minimizing collateral damage as the pieces fall to the ground.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile for an ammunition round, the projectile comprising:

a hardened penetrator assembly further comprising a penetrator nose, and a penetrator body positioned rearward and aligned with the penetrator nose, the penetrator body having a main cavity and a base cavity;

an explosive charge assembly housed within the main cavity, said explosive charge assembly further comprising a main explosive charge having a dual purpose of extending the ballistic effect of the projectile when a target is engaged and self-destructing the projectile when a target is not engaged, and a self-destruct initiation charge rearward of the main explosive charge for initiating the main explosive charge when a target is not engaged;

a tracer charge housed within the base cavity for tracing a projectile trajectory; and wherein after a predetermined time without engaging a target, the tracer charge heats a portion of the penetrator body between the self-destruct initiation charge and the tracer charge to a temperature sufficient to initiate the self-destruct initiation charge which in turn initiates the main explosive charge.

2. The projectile of claim 1 wherein the penetrator nose further comprises a hollow nose cavity with an opening in a base of the penetrator nose and extending axially into the penetrator nose a distance less than half of an axial length of the penetrator nose.

3. The projectile of claim 2 wherein the penetrator nose further comprises a conical body and a penetrating tip extending forward from a tip of the conical body.

4. The projectile of claim 2 further comprising a wind screen fixed to the penetrator nose.

5. The projectile of claim 1 wherein the hardened penetrator assembly is formed from a tungsten alloy.

6. The projectile of claim 1 wherein the explosive charge assembly further comprises an incendiary charge in communication with the explosive charge.

7. A projectile for an ammunition round, the projectile comprising:

a hardened penetrator assembly further comprising a penetrator nose formed from a tungsten alloy and comprising a conical body, a penetrating tip extending from a tip of the conical body, a cylindrical base extending from the rear of the conical body and a hollow nose cavity having an opening in the cylindrical base, and extending axially into the penetrator nose a distance less than half of an axial length of the penetrator nose, a penetrator body positioned rearward and aligned with the penetrator nose, the penetrator body formed from a tungsten alloy and having a main cavity having an opening in a front of the penetrator body and a base cavity having an opening in a base of the penetrator body, the main cavity partially receiving the penetrator nose;

an explosive charge assembly housed within the main cavity, the explosive charge assembly further comprising an explosive charge having a dual purpose of extending the ballistic effect of the projectile when a target is engaged and self-destructing the projectile when a target is not engaged and a self-destruct initiation charge rearward of the main explosive charge for initiating the main explosive charge when a target is not engaged;

a tracer charge housed within the base cavity for tracing a projectile trajectory and initiating the self-destruct initiation charge after a predetermined time in which a target is not engaged; and wherein after a predetermined time without engaging a target, the tracer charge heats a portion of the penetrator body between the self-destruct initiation charge and the tracer charge to a temperature sufficient to initiate the self-destruct initiation charge which in turn initiates the explosive charge.

8. The projectile of claim 7 wherein the penetrator further comprises a wind screen fixed to the penetrator nose.

9. The projectile of claim 7 wherein the explosive charge assembly further comprises an incendiary charge.

* * * * *